United States Patent [19]

Schillreff

[11] 4,183,302

[45] Jan. 15, 1980

[54] SEQUENTIAL BURST SYSTEM

[75] Inventor: George H. Schillreff, Glendora, Calif.

[73] Assignee: General Dynamics Pomona Division, Pomona, Calif.

[21] Appl. No.: 680,712

[22] Filed: Nov. 6, 1967

[51] Int. Cl.[2] ..... F42B 13/42

[52] U.S. Cl. ..... 102/89 CD; 102/34.4; 343/18 E

[58] Field of Search ..... 102/34.4, 49.4, 37.6, 102/37.7, 89; 343/18 B, 18 E

[56] References Cited

U.S. PATENT DOCUMENTS 2,476,302 7/1949 Jeppson ..... 102/37.7 X 3,302,759 3/1967 Sorenson ..... 343/18 E

*Primary Examiner*—Verlin R. Pendegrass

*Attorney, Agent, or Firm*—Lafayette E. Carnahan; Edward B. Johnson

[57] ABSTRACT

A system which disperses a payload sequentially. The payload may consist of a number of discrete individual units or a long string of units. The illustrated and described embodiment of the system is utilized in a rocket for dispersing decoy material, such as aluminum chaff, in a sequential burst pattern. The concept may readily be applied to mortor type decoy rounds, other types of decoy material, or to other types of applications requiring a sequential dispersion of the payload thereof.

10 Claims, 4 Drawing Figures

SEQUENTIAL BURST SYSTEM

BACKGROUND OF THE INVENTION

This invention relates to countermeasure systems, particularly to systems for providing a protective cover against homing and/or fire control devices operating upon infrared, sonar, or microwave reflected energy or for confusing search and tracking devices, and more particularly to a system for sequentially bursting the payload containing material capable of providing such a protective cover.

RELATED APPLICATIONS

This invention relates to the inventions disclosed and claimed in copending U.S. Patent Application Ser. No. 389,525 filed Aug. 12, 1964, entitled "Counter Measure System" and now U.S. Pat. No. 3,836,968; in copending U.S. Patent Application Ser. No. 421,754 filed Dec. 24, 1964 entitled "Portable Decoy Launcher System and Rounds Therefor", and now U.S. Pat. No. 3,808,940; and in copending U.S. Patent Application Ser. No. 515,493 entitled "Decoy Rounds and Their Method of Fabrication"; each assigned to the assignee of this application. While the above mentioned applications are directed to systems for dispensing infrared, sonar, or microwave-reflected energy or combinations thereof by firing a projectile or a plurality thereof and dispensing the same at a predetermined point in time or position along its trajectory or path of travel, this invention is more particularly directed to a system for sequentially bursting various sections of the payload such that a desired pattern of the decoy material may be produced, thereby serving as a more effective cover by confusing sensing mechanism of incoming missiles or the like and/or a means for more effectively confusing search and tracking radars.

SUMMARY OF THE INVENTION

This invention relates to a sequential burst system particularly adapted for dispersing the payload of a rocket or mortor round. The inventive system has particular application in dispersing decoy material, such as infrared, sonar, or microwave reflected energy, in a desired pattern for more effectively confusing search and tracking devices and for providing a protective cover against homing and/or fire control devices operating upon these types of energy. The system of the invention is adapted for utilization in rounds or the like which are utilized in launching mechanisms which can be located on land, sea-born vehicles, underwater vehicles, or air vehicles.

Therefore, it is an object of this invention to provide a sequential burst system.

A further object of the invention is to provide a sequential burst system for dispersing material in a desired pattern.

Another object of the invention is to provide a sequential burst system for the payload of a rocket-type or mortar-type decoy round.

Another object of the invention is to provide a system for dispersing infrared, sonar, or microwave reflecting material in a sequential manner.

Another object of the invention is to provide a rocket or mortor decoy round with a system for activating and sequentially bursting a plurality of discrete individual units containing the decoy material, thereby producing a desired pattern of material for more effectively confusing sensing devices operating on energy of the type produced by the dispersed material.

Other objects of the invention will become readily apparent from the following description and accompanying drawings wherein:

DESCRIPTION OF THE EMBODIMENTS

Figure 1:
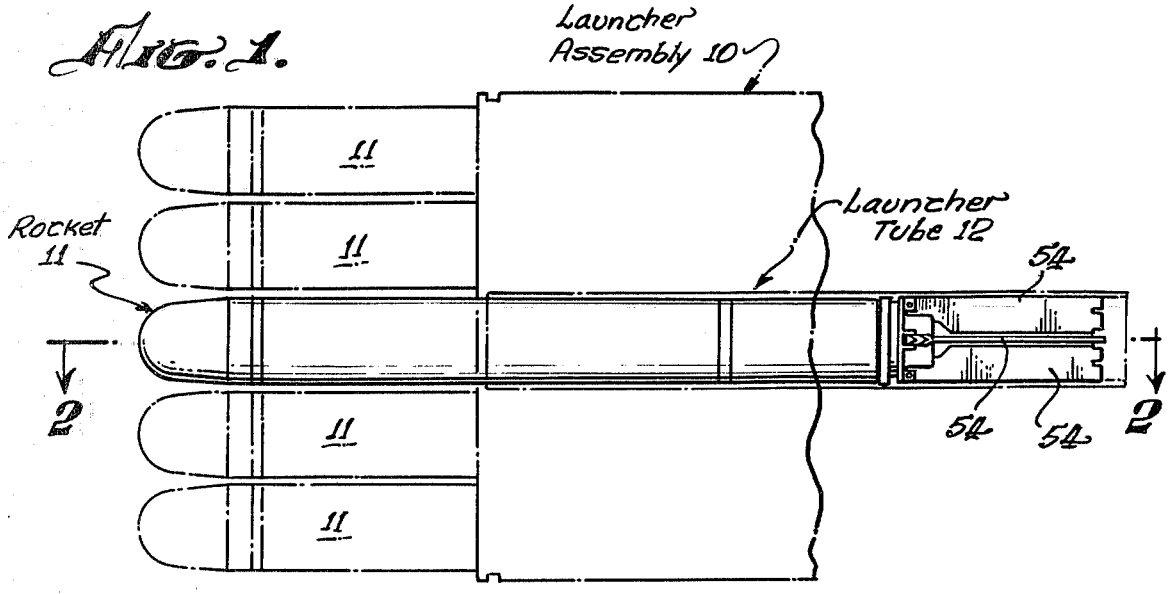
FIG. 1 is a partial view of a launcher system for rocket type rounds which utilize the inventive concept.

Referring now to FIG. 1 wherein is shown a launcher assembly generally indicated at 10 having mounted therein a plurality of rockets 11 (five rockets being illustrated in this embodiment). Since the launcher assembly 10 does not constitute part of this invention, details thereof have been omitted except for illustrating at 12 one of the launch tubes within which a rocket 11 is mounted and fired therefrom.

Figure 2:
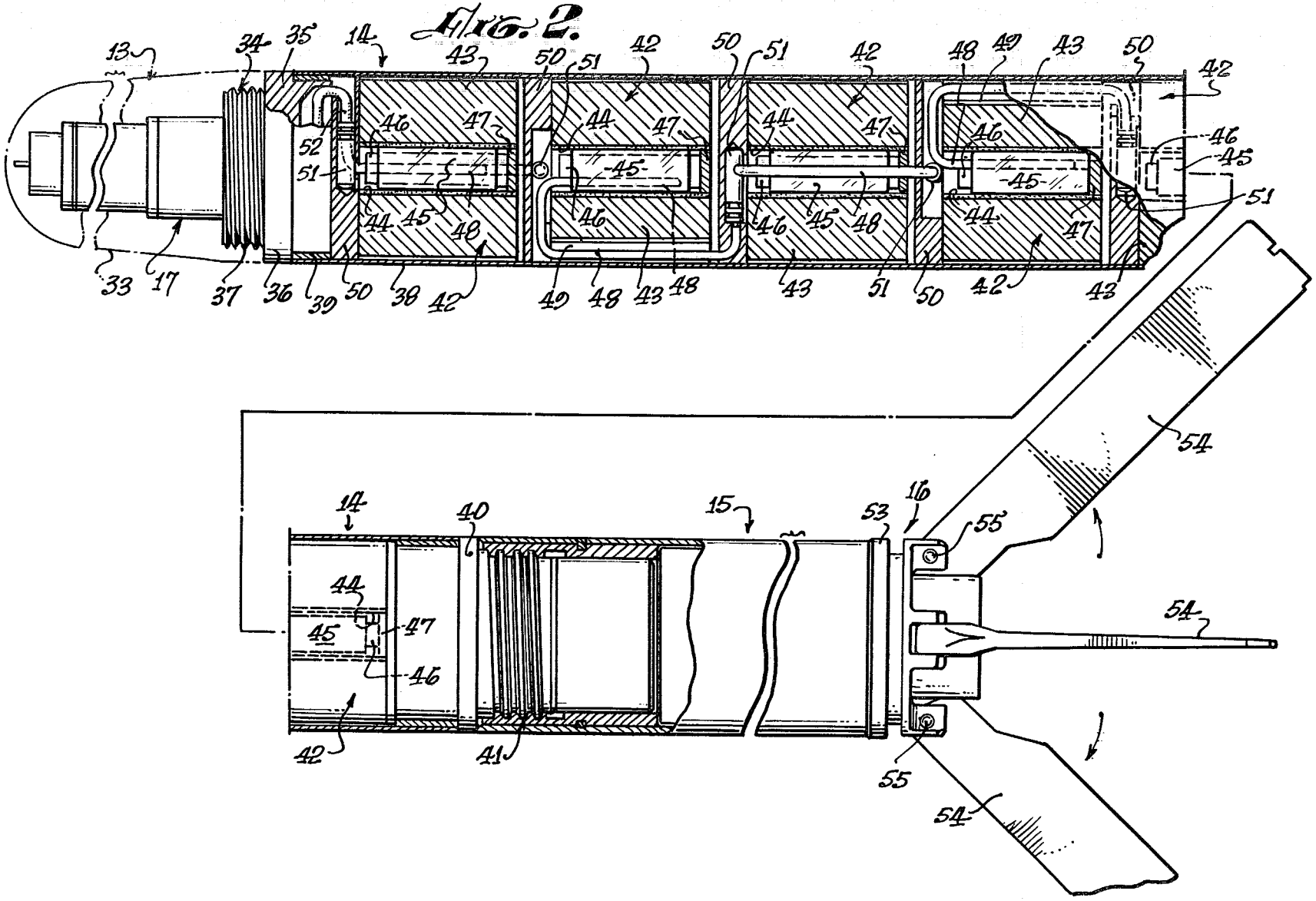
FIG. 2 is a partial enlarged view taken along line 2—2 of the FIG. 1 rocket embodiment with portions shown in cross-section and the tail fins in flight position.

The rocket 11, as shown in FIG. 2, comprises a head or nose cone section generally indicated at 13, a payload section generally indicated at 14, a motor section 15, and a tail section 16.

Figure 3:
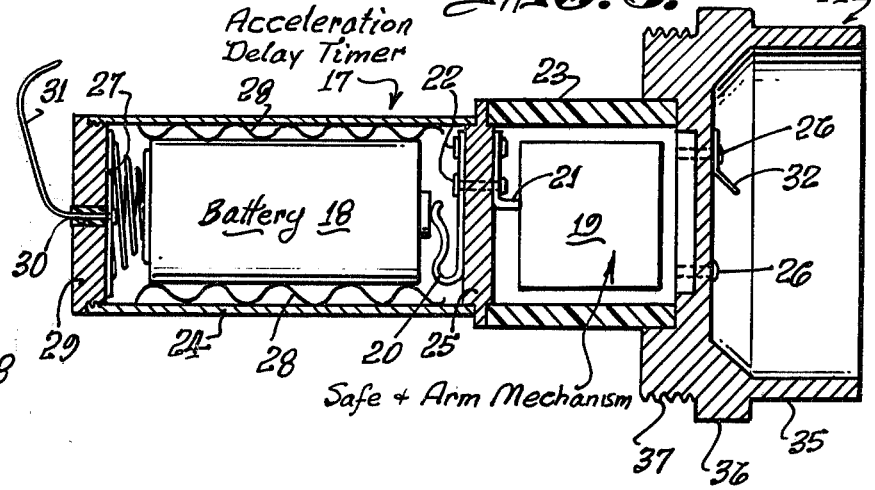
FIG. 3 is an enlarged view of an embodiment of the timing device of the FIG. 2 rocket.

The nose cone or head section 13 of rocket 11, as shown in FIGS. 2 and 3, includes an acceleration delay timer assembly generally indicated at 17 which comprises a battery 18 and a safe and arm mechanism generally indicated at 19. Since the safe and arm mechanism 19 does not constitute part of this invention, the details thereof are deemed unnecessary and therefore only a general description of its function will be set forth. Safe and arm melchanism 19 is operatively interconnected, as known in the art, with battery 17 via a battery contact 20 which is electrically connected with a contact 21 of mechanism 19 by machine screws, rivets, or other suitable means as indicated at 22. Mechanism 19 is mounted in a housing 23 while battery 18 is mounted in a housing 24, housings 23 and 24 being secured together on opposite sides of a connector plate 25 through which machine screws 22 extend. Housing 23 is secured to the forward end of rocket payload section 14 via machine screws or rivets 26. Battery 18 is biased within housing 24 by contact 20 and a turntable mounting spring 27 at opposite ends thereof. As illustrated in FIG. 3, the battery 18 may be biased from side movement by a cardboard or spring wrapping as illustrated at 28. Battery housing 24 is provided with a removable end cap or member 29; the adjustment of which serves to change the tension of spring 27. Cap 29 is provided with a central operature 30 through which an electrical lead 31 extends, lead 31 being operatively connected to spring 27. A lead or lug 32 is electrically connected to mechanism 19 and secured to the forward end of rocket payload section 14 by one of the machine screws 26. The housings 23 and 24 are covered by a dome 33 constructed of suitable material and threadedly secured at 34 to the forward end of rocket payload section 14. The operation of the FIG. 3 acceleration delay timer 17 will be described hereinafter with respect to the operation of the FIG. 2 rocket.

The payload section 14 of rocket 11, as shown in FIG. 2 comprises a nose cone or head adapter member 35 (see FIG. 3) which includes a flange or raised portion 36 which serves as an abuttment when the dome 33 is threadedly secured to section 14 at 34 by threads 37 on the forward end of adapter member 35. A skin or casing 38, constructed of suitable frangible material such as phenolic, is secured to the adapter 35 rearwardly of flange 36 by suitable bonding material as indicated at 39. Note that the external surfaces of dome 33, flange 36 and casing 38 form a substantially continuous surface. Casing or skin 38 terminates at the rearward end in a motor adapter 40 to which the rocket motor section 15 is threadedly secured at 41. Since the motor adapter 40 or the motor section 15 do not constitute a part of this invention a detailed description thereof is deemed unnecessary, particularly since the illustrated adapter arrangement is well known in the art. Positioned within skin or casing 38 is a number of individual payload units generally indicated at 42 (five such units being shown in this embodiment) of suitable decoy material for confusing or attracting devices operating upon infrared, sonar, or microwave reflected energy. The specific illustrated payload material of units 42 in this embodiment is composed of suitably constructed aluminum chaff.

Each of the payload units 42, as shown, are substantially identical, but may be constructed so as to have various lengths such that the desired burst pattern of the decoy material may be accomplished. Units 42 each comprise a chaff load 43 having a central opening 44 therein within which is positioned a dispersion assembly generally indicated at 45 and which includes a burst or dispersion explosive holder 46 containing PETN or other suitable material, a blast plug 47 constructed of mild steel or other appropriate material, and a strip of primacord 48 or other suitable fusing means. The general construction of chaff load 43 is not part of this invention and the detials thereof will not be described, but may, for example, be similar to that illustrated and described in the above mentioned copending applications Ser. No. 421,754 and Ser. No. 515,493. Each of units 42 are provided with an insert casing 49 (only two shown), which, while not shown in cross-section, may have a V or U cross-sectional configuration and provide passageways through which primacord 48 extends from one unit 42 to the next, as seen in FIG. 2. Positioned at the forward end of each of payload units 42 is an isolation disc assembly 50 which may be, for example, constructed of mild steel. Disc assembly 50 is provided with a cutaway section within which is mounted a time delay cap assembly generally indicated at 51. If desired disc assembly 50 may be replaced by an isolation disc and a time delay assembly casing. The cutaway section of disc assembly 50 is constructed to align with the insert casing 49 and the central aperture 44 of the payload unit 42 whereby Primacord 48 may be operatively connected with time delay cap assembly 51 as shown in FIG. 2. Interconnecting the acceleration delay timer assembly 17 and the forward time delay cap assembly 51 is a length of primacord 52 which functions, as described hereinafter, to activate the sequential burst system.

Figure 4:
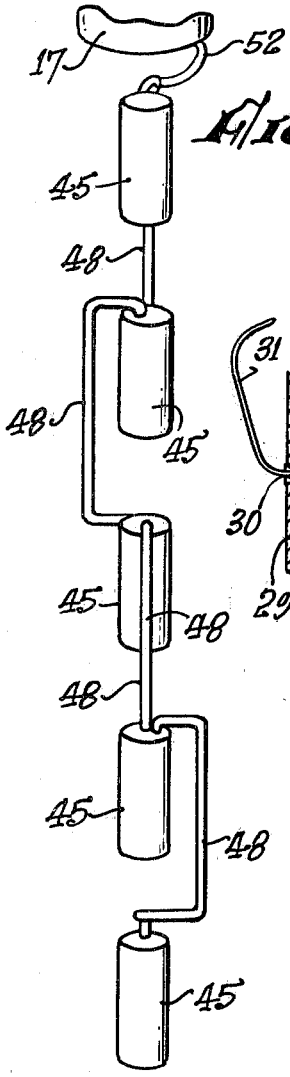
FIG. 4 is a diagrammatic illustration of the sequential fusing system utilized in the FIG. 2 rocket.

The arrangement of the fusing mechanism of the FIG. 2 embodiment is diagrammatically shown in FIG. 4 wherein the Primacord 48 interconnecting the first and second of the dispersion assemblies 45 is positioned about 90° with respect to the location of the Primacord 48 interconnecting the section and third assemblies 45, and so forth. However, other arrangements such as a 180° or other offset positioning between units may be effectively utilized. The offset positioning of the interconnecting Primacord 48 serves to (1) burst or split the frangible casing or skin 38 at different locations when the Primacord is ignited; and (2) provide an effective method for developing a desired pattern of the decoy material when the units 42 are dispersed by the charge in holder 46.

The tail section 16 includes an adapter indicated generally at 52 which functions to secure tail section 16 to motor section 15, and four tail fins 54 (only three being shown) pivotally mounted at 55. FIG. 1 shows the tail fins 54 in the stowed or launch position within launch tube 12 of launcher assembly 10, while FIG. 2 illustrates the fins 54 in extended or flight position. Since the tail section 16 does not constitute part of this invention, greater details are deemed unnecessary.

In operation, the rocket 11 is launched and the acceleration delay timer 17 is activated, as known in the art. The sequential burst system is initiated by a blasting cap or equivalent initiating device (not shown) which has been activated by the timer assembly 17 located in nose cone 13 via connections or leads 31 and 32 as known in the art. This initiation causes an explosive front to progress down the lead or Primacord 52 (which may, for example, be of the 6 grain/ft. type) to the first delay cap assembly 51 whereupon it is delayed an amount of time dependent upon its internal construction. Delay cap assemblies 51 may be manufactured for various delays ranging from 1 millisecond to 1 second. At the end of the delay period, the first cap assembly 51 explodes causing two things to occur:

1. The disbursing explosive (PETN, in this example) contained in holder 46 is initiated which disperses the tightly packaged chaff 43 in the forward payload unit 42 and destroys the frangible outer skin 38 of that unit and cuts off the skin or casing 38 at the approximate location of the isolation disc assembly 50 positioned forward of the second payload unit 42, and;

2. Ignites the lead cord or Primacord 48 of the forward payload unit 42 (6 grain/ft. PETN cord in this example) which causes an explosive front to progress down the side of the forward unit 42 via the insert casing 49 thereof to activate the time delay cap 51 of the second section or unit 42. This explosive front travelling down the side of the first section or unit 42 also serves to split the frangible skin 38 so that the explosive charge in holder 46 can more effectively disperse the chaff 43. The first blast plug 47 and the second isolation disc assembly 50 serve to protect the subsequent section or unit 42 so that no damage is done and the sequential function can operate smoothly.

As each section or unit 42 is sequentially exploded and the chaff 42 thereof disbursed, the rocket payload section 14 becomes shorter by the length of the expended or dispersed segment or unit 42.

The payload units 42 can be made in various lengths (giving consideration to aerodynamic stability of the rocket) as might be required by a tactical situation. Furthermore, there can be more or less than the five sections or units shown. There can also be utilized different sized sections or units, or units that contain different payloads. Also, the type of round may be of the mortor launched type. In addition, appropriate electrical type fusing may be utilized between the timer assembly 17 and the first time delay cap assembly 51.

It has thus been shown that this invention provides a sequential burst system which can effectively disburse payload units of desired size in a desired pattern, and which is particularly adapted to but not limited to an effective system for dispersing decoy material for confusing or attracting devices operating upon infrared, sonar, or microwave reflected energy.

When particular embodiments of the invention have been illustrated and described, modifications and changes will become apparent to those skilled in the art, and it is intended to cover in the appended claims all such modifications and changes as come within the spirit and scope of this invention.

What I claim is:

1. In a decoy round containing at least a nose cone section, a payload section, and a propulsion section, a sequential burst system comprising: a timing mechanism, at least two time delay assembly means positioned in different predetermined portions of said payload section, means within each of said predetermined payload section portions for dispersing said portions, fuse means interconnecting said time delay assembly means and extending adjacent an external surface of said payload section portions for splitting the skin thereof upon activation of said fuse means and for activating the next of said time delay assembly means, and means operatively connected with said timing mechanism for activating a first of said time delay assembly means, whereby after a predetermined condition of flight of said round the timing mechanism initiates said sequential burst system by activating said time delay activating means which initiates operation of said first of said time delay assembly means which in turn activates a first of said payload section portion dispersing means and a first of said interconnecting fuse means thereby dispersing said first payload section portion while substantially simultaneously splitting the skin of said payload section portion and activating the next time delay assembly means which similarly causes the next payload section portion to be dispersed and so on throughout the payload section.

2. The sequential burst system defined in claim 1, wherein said timing mechanism is operatively mounted in said nose cone section of said decoy round.

3. The sequential burst system defined in claim 1, wherein said payload section portions constitute individual payload units, each of said payload units being separated by isolation assembly means, said payload section portion dispersing means being located longitudinally along the center of said payload units.

4. The sequential burst system defined in claim 3, wherein said time delay assembly means are operatively positioned in said isolation assembly means.

5. The sequential burst system defined in claim 3, wherein said payload units are each provided with a recessed portion through which said interconnecting fuse means extends.

6. The sequential burst system defined in claim 1, wherein one of said interconnecting fuse means extends along said payload section portion at a location which is offset with respect to the location at which the next interconnecting fuse means extends along its associated payload section portion.

7. The sequential burst system defined in claim 1, wherein said payload section contains decoy material for devices operating upon infrared, sonar, and microwave reflected energy when utilized both singly and in any combination thereof.

8. The sequential burst system defined in claim 1, wherein said round additionally includes a tail section operatively attached to said propulsion section, thereby defining a rocket type round.

9. The sequential burst system defined in claim 1, wherein said payload section portions comprise a plurality of individual payload units positioned within a frangible outer skin and separated from one another by isolation assemblies within which said time delay assembly means for the associated payload unit is operatively positioned; each of said payload units being composed of a body of decoy material capable of generating energy selected from the group consisting of infrared, sonar, and microwave reflected energy; each of said decoy material bodies being provided with a central opening and a recessed area long the external surface thereof; each of said payload units having one of said payload section portion dispersing means operatively positioned within said central opening of said decoy material body and one of said interconnecting fusing means extending along said recessed area of said decoy material body, said time delay assembly means for each payload unit being operatively connected with said payload section portion dispersing means and with said interconnecting fusing means thereof.

10. The sequential burst system defined in claim 9, wherein said payload section portion dispersing means comprises an explosive holder assembly within which is contained a predetermined type of explosive, and additionally including a blasting plug of suitable material positioned intermediate said explosive holder assembly and the isolation assembly adjacent the next payload unit.

* * * * *